United States Patent [19]

Holland

[11] Patent Number: 5,058,295

[45] Date of Patent: Oct. 22, 1991

[54] REAR-MOUNTED SCRAPER

[76] Inventor: William H. Holland, W6791 Pond View Rd., Monroe, Wis. 53566

[21] Appl. No.: 620,524

[22] Filed: Nov. 29, 1990

[51] Int. Cl.[5] ..... E01H 5/06; E02F 3/815

[52] U.S. Cl. ..... 37/268; 37/236; 172/445.1; 172/799.5

[58] Field of Search ..... 37/122, 231, 236, 266, 37/268, 269; 172/799.5, 443, 445.1

[56] References Cited

U.S. PATENT DOCUMENTS

| | | | |
|---|---|---|---|
| 2,059,818 | 11/1936 | Simon | 37/268 |
| 2,266,625 | 12/1941 | Cundiff | 172/799.5 |
| 2,622,349 | 12/1952 | Kinnan | 37/236 X |
| 3,302,317 | 2/1967 | Domres | 172/799.5 |
| 3,800,447 | 4/1974 | Harvey | 37/268 |
| 3,893,248 | 7/1975 | Young | 37/268 |
| 3,924,689 | 12/1975 | Manor | 172/799.5 |
| 4,403,432 | 9/1983 | Biance | 37/235 |
| 4,805,322 | 2/1989 | Lemire et al. | 172/445.1 X |
| 4,907,357 | 3/1990 | Lilienthal | 37/268 X |

FOREIGN PATENT DOCUMENTS

| | | | |
|---|---|---|---|
| 197710 | 10/1977 | U.S.S.R. | 172/799.5 |
| 1421821 | 9/1988 | U.S.S.R. | 37/231 |
| 992049 | 5/1965 | United Kingdom | 172/445.1 |

OTHER PUBLICATIONS

Weaver Manufacturing brochure, Artic Snow Plows, Plow Partner, Mounting Kit #51191.

*Primary Examiner*—David H. Corbin
*Assistant Examiner*—Arlen L. Olsen
*Attorney, Agent, or Firm*—Lathrop & Clark

[57] ABSTRACT

The rear-mounted scraper of this invention is adapted for attachment to the rear of a vehicle which has a rear bumper, bottom and a rear axle. The rear-mounted scraper has a hitch with portions adapted for attachment to the bottom of the vehicle and portions defining pivotal attachment points which define a horizontal pivot axis. The pivot axis of the attached hitch is spaced from the rear axle and the rear of the vehicle and is beneath the bottom of the vehicle. The plow also has a scraper assembly which has a blade an extension which extends forward from the blade and is pivotally mounted at the hitch pivot points to enable the scraper assembly to pivot about the horizontal pivot axis. A linear actuator is pivotally attached to the scraper assembly and to the hitch at a position near the bottom of the vehicle rear between the pivot axis and the vehicle rear axle such that operation of the linear actuator causes the scraper assembly to pivot about the pivotal attachment points on the hitch and thus move the blade from a lowered, ground-engaging, snowscraping, position to a raised position beneath the vehicle and substantially forward of the rear bumper.

9 Claims, 5 Drawing Sheets

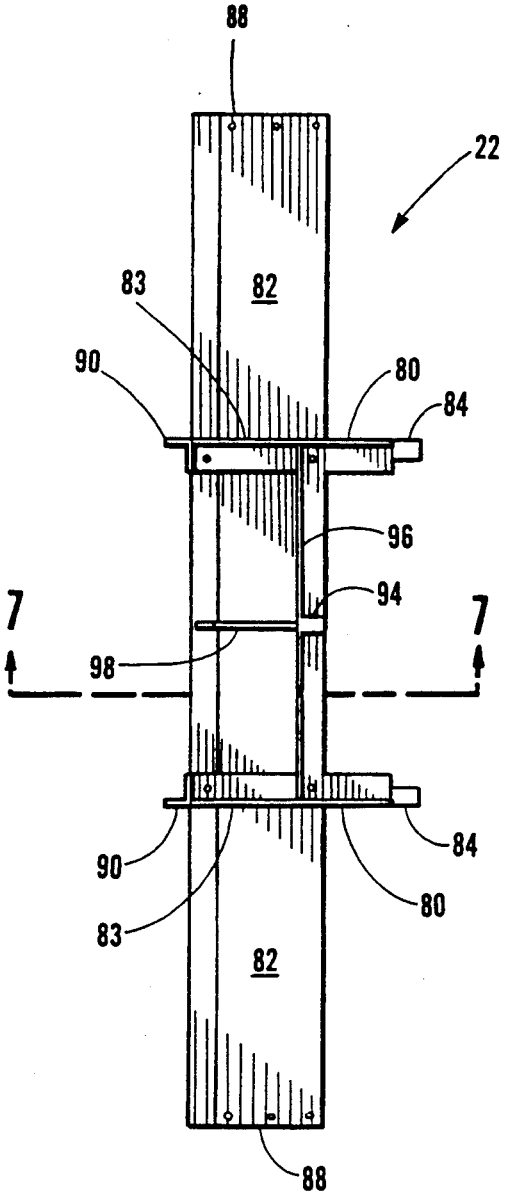
FIG. 6
FIG. 7
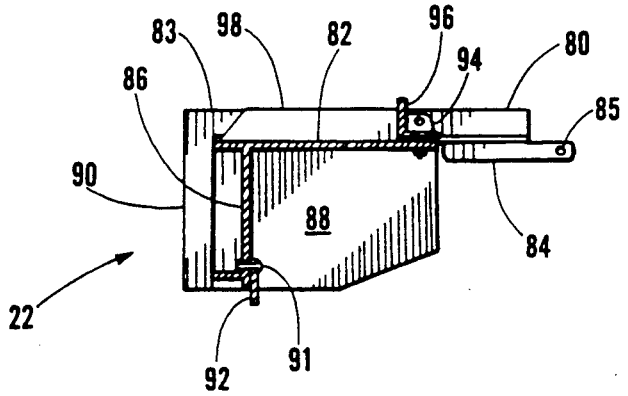

REAR-MOUNTED SCRAPER

FIELD OF THE INVENTION

This invention relates generally to snowplows and particularly to rear-mounted scrapers.

BACKGROUND OF THE INVENTION

Every year people in the Northern climes must deal with the yearly problem of snow removal. The problem is particularly onerous for the homeowner wishing to clear his driveway or the small business owner wishing to clear the parking lot of his establishment. They cannot afford the large and expensive special purpose equipment and teams of trained operators which municipalities and large businesses use to clear snow from their streets and facilities.

The solution for the small business owner involves placing a plow attachment on the front of a pick-up truck or other utility vehicle to make the services of a snowplow available.

For the homeowner, the solution often involves hiring one of those entrepreneurs who earn a portion of their income each year by clearing homeowners' driveways for a seasonal fee. These entrepreneurs are faced with the task of rapidly clearing a number of driveways after each snowfall and are constrained by the requirement of keeping their capital expenditures low. Furthermore, they must move their snow removal equipment from one customer's residence to another which may be some distance apart.

The snow removal entrepreneur or small business owner will usually employ a snowplow mounted on a truck which may also serve as the personal vehicle of the entrepreneur.

A front-mounted snowplow is designed to be used while driving forward and is very effective for snowplowing roads, lanes and large parking lots. Front mounted plows, however, present a problem when snowplowing small residential driveways or parking lots in confined places. In these situations, when the snow cannot be pushed forward, the snow must be pulled backwards some distance, then the truck must be turned around and backed over the snow and used to push the snow away. This operation creates several problems. Since the snowplow is usually concave for forward plowing, it presents a convex face when moving backwards, so it does not function well. Additionally, the plow has no downward pressure other than its weight, a few hundred pounds. This low weight combined with a convex shape results in a tendency of the plow to ride up over deep or heavy wet snow. Furthermore, the plow lacks sufficient downward pressure to break through frozen compacted snow or ice.

To overcome these problems, rear scrapers, which attach to the rear of the truck and which utilize the weight of the truck to generate downward pressure have been developed.

Known rear scrapers have limitations which interfere with the general utility uses of the truck or vehicle. These known rear scrapers require removal of the bumper and extend past the end of the truck or lie over the truck bed in the retracted position. Known rear scrapers can be difficult to install requiring extensive modification of the rear-end of the truck. Known rear scrapers can interfere with the general utility of the truck by extending its length or decreasing the truck s over-the-road clearance.

What is needed is a scraper for mounting on the rear of a truck which is disposed substantially beneath the truck and which does not decrease the over-the-road clearance of the truck and which may be installed with relatively slight modification of the rear end of the truck.

SUMMARY OF THE INVENTION

The rear-mounted scraper of this invention is adapted for attachment to the rear of a vehicle which has a rear bumper, bottom and a rear axle. The rear-mounted scraper has a hitch with portions adapted for attachment to the bottom of the vehicle and portions defining pivotal attachment points which define a horizontal pivot axis. The pivot axis of the attached hitch is spaced from the rear axle and the rear of the vehicle and is beneath the bottom of the vehicle. The scraper also has a scraper assembly which has a blade and an extension which extends forward from the blade and is pivotally mounted at the hitch pivot points to enable the scraper assembly to pivot about the horizontal pivot axis. A linear actuator is pivotally attached to the scraper assembly and to the hitch at a position near the bottom of the vehicle rear between the pivot axis and the vehicle rear axle such that operation of the linear actuator causes the scraper assembly to pivot about the pivotal attachment points on the hitch and thus move the blade from a lowered, ground-engaging, snowplowing, position to a raised position beneath the vehicle and substantially forward of the rear bumper.

It is an object of the present invention to provide an effective apparatus for clearing snow from areas bounded by some form of obstruction.

It is a further object of the present invention to provide a rear-mounted scraper which does not substantially decrease the manueverability of the vehicle.

It is another object of the present invention to provide a rear-mounted scraper which may be mounted on the rear of a vehicle with minor modifications to the vehicle.

It is also an object of the present invention to provide a rear-mounted scraper which does not decrease the over-the-road clearance of the vehicle.

It is a still further object of the present invention to provide a rear scraper which does not require the removal of the rear bumper for mounting.

It is yet another object of the present invention to provide a rear scraper which does not extend beyond the rear bumper of the truck or vehicle to which it is attached.

Further objects, features, and advantages of the invention will be apparent from the following detailed description when taken in conjunction with the accompanying drawings.

BRIEF DESCRIPTION OF THE DRAWINGS

FIG. 6 is a top plan view of the scraper assembly of the rear scraper of this invention.

FIG. 7 is a cross sectional view of the scraper assembly of FIG. 6 taken along sectional lines 7—7.

DESCRIPTION OF THE PREFERRED EMBODIMENT

Figure 1:
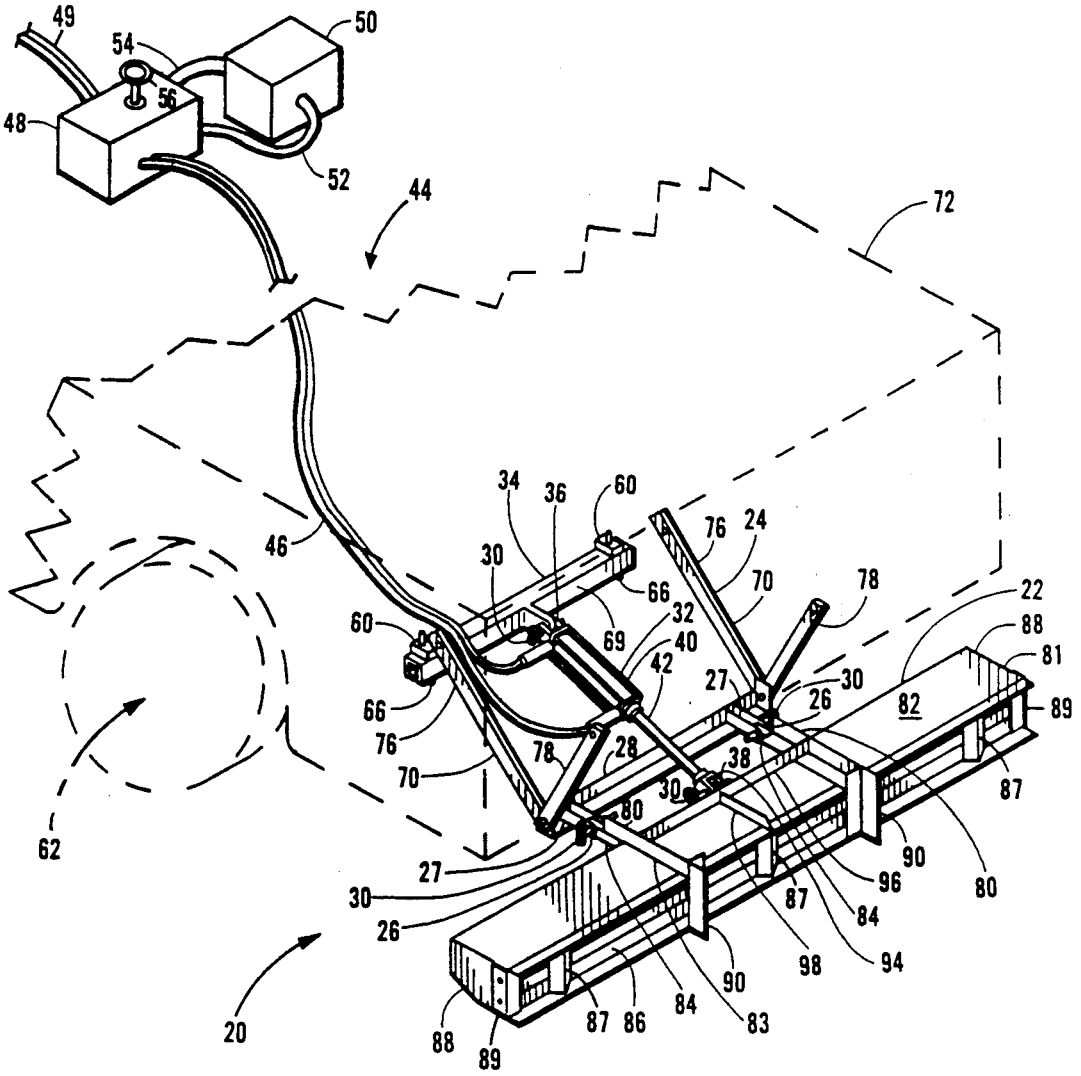
FIG. 1 is an isometric view of the rear scraper of this invention mounted to a vehicle with a schematic representation of the hydraulic system.

Referring more particularly to FIGS. 1–7 wherein like numbers refer to similar parts, a rear scraper 20 is shown in FIGS. 1–5. The scraper of this invention is comprised of three major components: a hitch 24, best seen in FIGS. 1, 4, and 5; a scraper assembly 22, best seen in FIGS. 1, 2, 3, 6 and 7; and a linear actuator 32.

The rear scraper 20 is suited for attachment to the rear 72 of a vehicle 62, which will generally be a conventional pickup truck. The truck 62 has an exposed structural frame 64 at its underside or bottom 73. Also exposed is the rear axle 68 and differential 74 of the vehicle 62. The scraper 20 is adapted to fit compactly beneath the vehicle 62 by fixed attachment of the hitch 24 to the bottom 73 of the vehicle 62.

Figure 2:
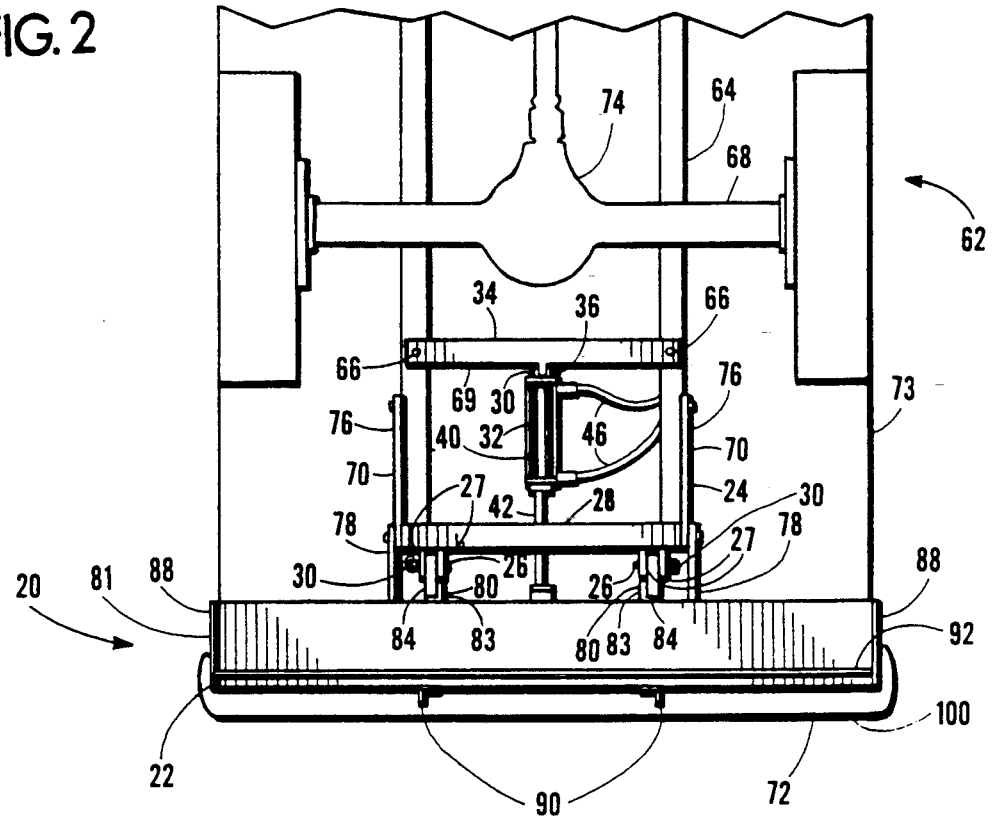
FIG. 2 is a bottom plan view of the mounted rear scraper of FIG. 1.
Figure 3:
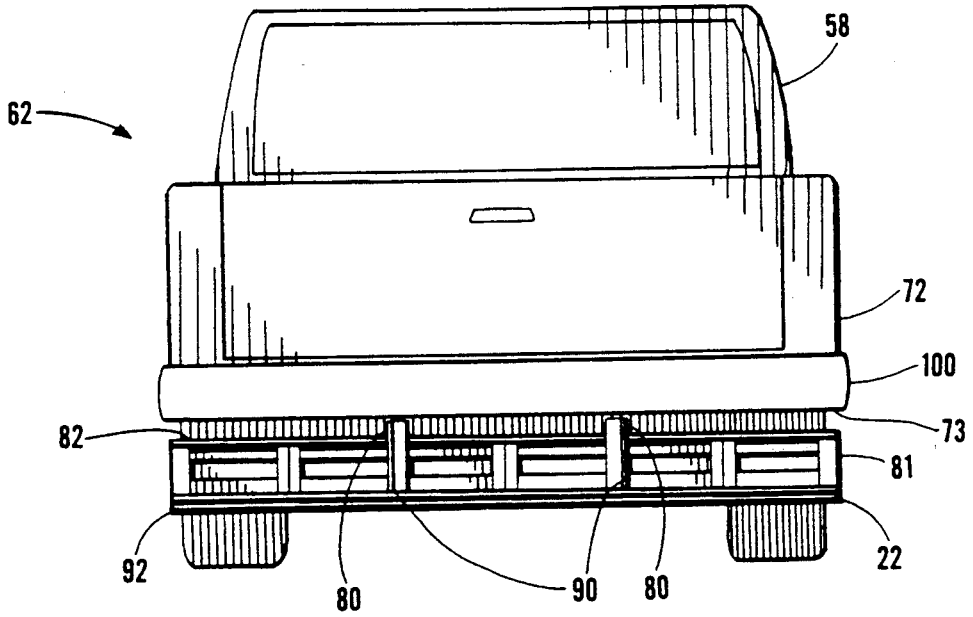
FIG. 3 is a rear elevational view of the mounted scraper of FIG. 1.

The hitch 24 has an upper mounting bar 34 which is preferably constructed of 3-inch square tubular steel and is spaced from the frame 64 by steel spacers 60 which may be necessary to clear obstructions such as the gas tank on the underside of the truck 62. The upper mounting bar 34 and the spacers 60, which are approximately an inch thick, are mounted to the truck frame 64, as best shown in FIG. 2, by $\frac{5}{8}$-inch bolts 66. The upper mounting bar 34 is located behind and in proximity to the rear axle 68. The upper mounting bar 34 has a bracket 36 for mounting the hydraulic actuator 32. The bracket 36 is preferably located on the rearward face 69 of the mounting bar 34 as best shown in FIG. 1.

Figure 4:
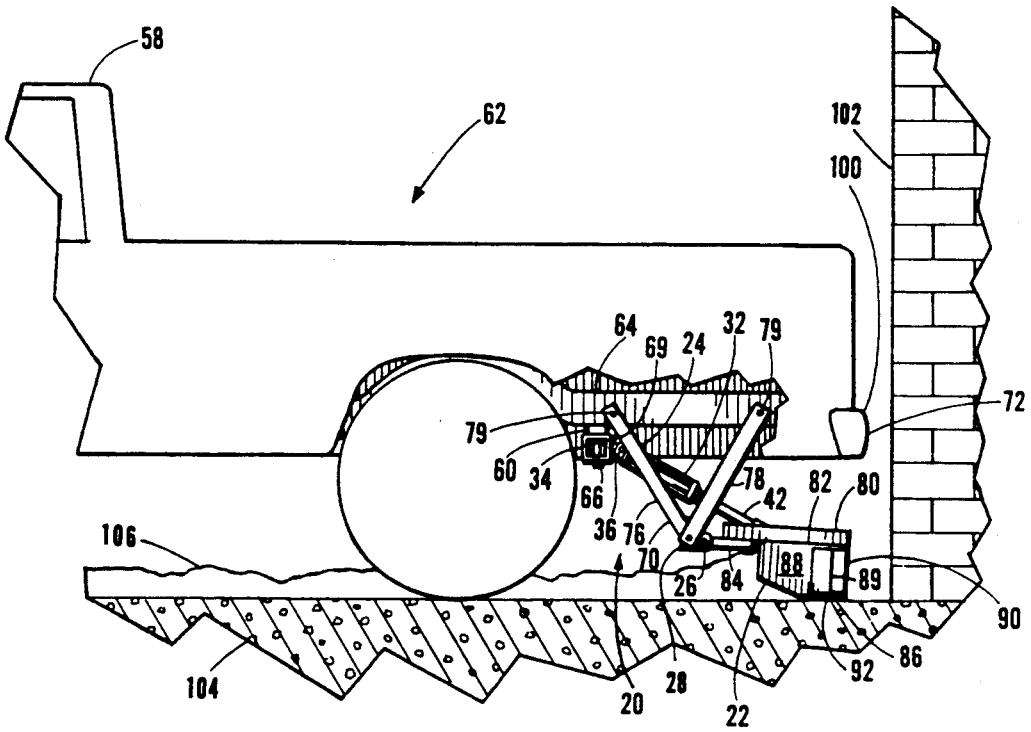
FIG. 4 is a side elevational view partially cut away to show the scraper of this invention mounted on the rear of the truck and extended for scraping.
Figure 5:
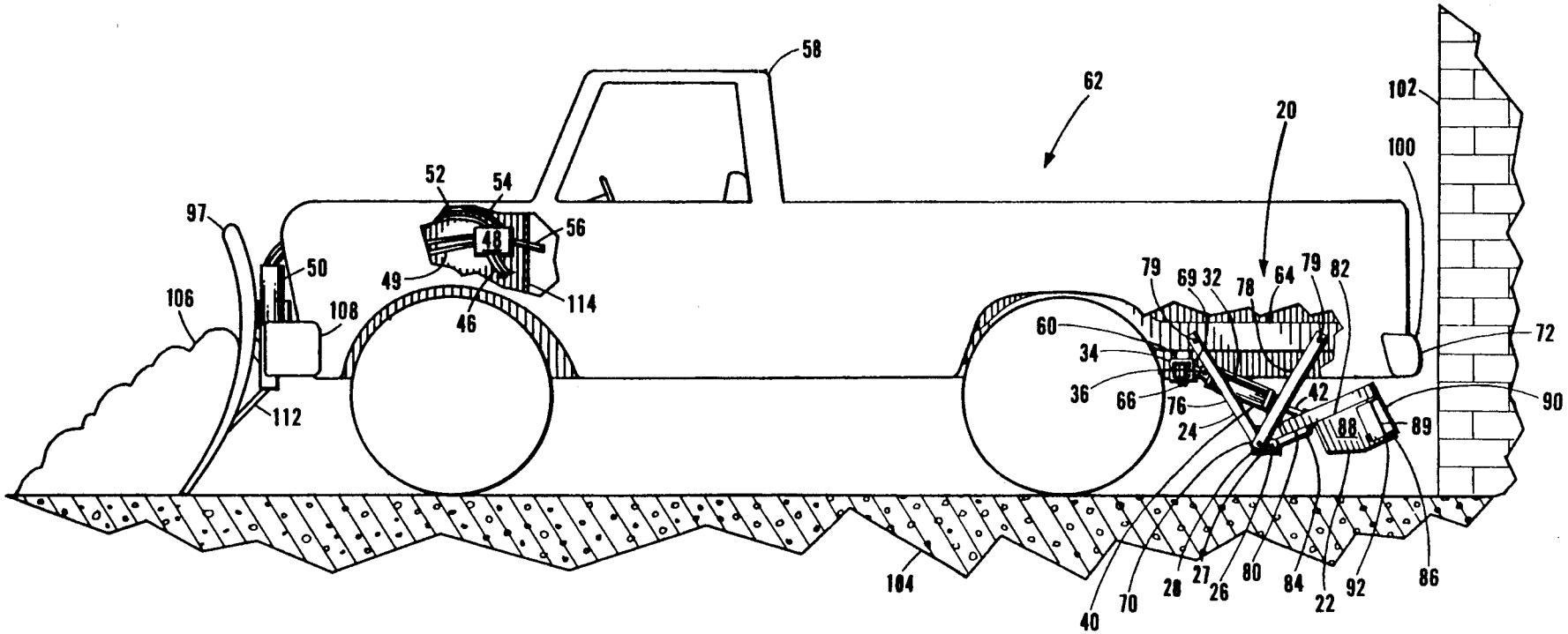
FIG. 5 is a side elevational view of the apparatus of FIG. 4 showing the scraper retracted and a front-mounted plow moving the scraped snow forward.

The hitch 24 has two v-trusses 70 each of which is composed of a forward bar 76 and a rear bar 78. The forward 76 and rear bars 78 are preferably constructed of steel approximately 24 inches long by 2 inches wide by $\frac{1}{2}$-inch thick and are of equal length. One end of the forward bar 76 is bolted to the truck frame 64 with $\frac{1}{2}$-inch bolts 79 as shown in FIGS. 4 and 5. The forward bars 76 are attached to the vehicle frame 64 above and to the rear of the truck's axle 68 in the vicinity of the upper mounting bar 34. The rear bar 78 is attached to the frame of the vehicle 64 at a location rearwardly spaced from the attachment point of the forward bar and forward of the rear of the truck 72. The free ends of the forward bar 76 and rear bar 78 are joined and support the hinge bar 28 approximately 20 inches below the truck frame 64.

The hinge bar 28 has portions which project rearwardly to serve as pivot brackets 27. The brackets 27 support the attachment points 26 for pivotal mounting of the scraper 22. The hinge bar 28 is rigidly connected to the two v-shaped trusses 70, which support the hinge bar 28 beneath the truck 73. The hinge bar 28 is mounted to be horizontally spaced between the upper mounting bar 34 and the rear of the truck 72. The hinge bar 28 is preferably supported so that the clearance between the hinge bar 28 and the road is at least equal to the road clearance of the rear axle differential 74, which in an exemplary truck is approximately 9 inches.

The scraper assembly 22 has a open-box like blade 81, with horizontal extensions 80 for attachment of the scraper assembly to the hitch 24.

The blade 81, best shown in FIGS. 6 and 7, is approximately 84 inches wide, $9\frac{1}{2}$ inches high and $11\frac{1}{2}$ inches from front to back. The blade 81 has a top face 82, a rear side face 86 depending downwardly from the top face 82 and two end faces 88 connected to the top face 82 and the rear face 86 by means of bolts and welding. The blade 81 is also bolted and welded to the horizontal extensions 80 and the reinforcing angles 90.

The blade 81 has reinforcing braces 87 on the rear side face 86 which reinforce the rear side face 86. The rear side face 86 is joined to the end faces 88 by a corner reinforcing 89 which is bolted to end face 88 and rear face 86.

Each of the two horizontal extensions 80 on the top face 82 of the scraper 22 are constructed from a $\frac{1}{4}$ inch$\times\times 2\frac{1}{2}$ inch angle iron 83, and $1\frac{1}{4}$ inch bar stock projection 84 which is welded onto the front of the angle iron 83 and projects forward. The bar stock has a $\frac{5}{8}$-inch hole 85 which accepts a $\frac{5}{8}$-inch pin 30 as best seen in FIG. 7. The pins 30, as best seen in FIG. 1, attach the scraper assembly 22 to the hinge bar 28 at the brackets 27.

A cutting bar 92 is attached to the bottom of the rear side 86 of the blade of the scraper assembly 22 and preferably bolted to the vertical reinforcing members 90 with $\frac{1}{2}$-inch carriage bolts 91. The cutting bar 92 forms the interface between the scraper assembly 22 and the ground and is subject to wear when the scraper assembly 22 slides over concrete or asphalt paving. It is, therefore, constructed of a wear-resistant material such as high carbon steel and is bolted or otherwise attached to the scraper assembly 22 so that it may be easily replaced. When new, the cutting bar 92 may extend an inch or more below the end faces 88 and would be replaced when worn away to the height of the end faces 88. The cutting bar 92 in the preferred embodiment is $4\frac{1}{2}$ inches high, $\frac{1}{2}$ inch thick, and the length of the scraper assembly 22, which is approximately 84 inches.

A scraper linear actuator attachment bracket 94 is mounted to a piece of $2\frac{1}{2}\times 2\frac{1}{2}\times\frac{1}{4}$ angle iron 96 which runs between the horizontal extensions 80. A bar stock extension 98 communicates with the angle iron 96 and the rear face 86.

The linear actuator 32, preferably a hydraulic piston cylinder assembly, is mounted between the scraper assembly 22 at the attachment bracket 94 and the upper mounting bar 34 at a pivotal mounting bracket 36. The hydraulic actuator 32 has a double acting cylinder 40 which by means of hydraulic pressure extends and retracts a hydraulic piston 42 which causes the rotation of the scraper assembly 22 about a horizontal axis defined by the pivotal attachment points 26 to raise the scraper assembly 22 as seen in FIG. 5 with the piston 42 retracted or to lower the scraper assembly 22 as seen in FIG. 4 with the piston 42 extended.

The hydraulic system 44 for controlling the hydraulic cylinder 32 is shown schematically in FIG. 1. Hydraulic hoses 46 alternately supply hydraulic fluid or allow the return of hydraulic fluid causing the piston 42 to extend or retract. A hydraulic double selector valve 48 controls the supply of hydraulic pressure to the cylinder 40. The double selector valve 48 has hydraulic lines 49 leading forward to the front plow 97. The valve 48 itself is connected to a conventional hydraulic pump or power source 50 via a high-pressure line 52 and a return line 54. The valve 48 may conveniently be controlled by an electrical actuator or mechanical control rod 56 conveniently located in the vehicle cab 58.

The hydraulic system 44, in the preferred embodiment, is integrated with the hydraulic system used in operating the front plow 97. The integration of the rear scraper 20 hydraulic system with the front plow 97 hydraulic system is accomplished by bringing the high-pressure line and the return line 54 from a conventional hydraulic pump and power source 50 to a hydraulic double selector valve 48 wherein the hydraulic power may be alternatively supplied to the front plow 97 or the rear scraper 20 hydraulic actuator. The operation of the hydraulic double selector valve 48 may be achieved by control rods which penetrate into the cabin and by means of which the hydraulic double acting selector valve 48 may be caused to switch hydraulic power from the front snowplow 97 to the rear scraper 20.

Although the hydraulic system 44 is shown schematically in FIG. 1, the preferred locations of the parts (shown in FIG. 5) are as follows: the hydraulic pump or power source 50 will conventionally be located above the front bumper 108 on the forward snowplow 97 hitch 112 and the hydraulic double selector valve 48 will be located in the engine compartment, preferably near the fire wall 114 of the vehicle, such that the control rod 56 may pass through the fire wall of the vehicle and be actuatable from under the dash on the driver's side of the vehicle 62. Under the dash, located close to the mechanical control rod 56, will be a conventional electric switch for actuating the hydraulic power source 50 to power alternatively the front snowplow 97 or the rear scraper 20.

In connecting the scraper assembly 22 to the hitch 24, the linear actuator 32 is attached by a removable pin 30 to the mounting bracket 36 on the upper mounting bar 34, the hydraulic hoses 46 attached, and the piston 42 extended to maximum extension. The linear actuator 32 is then pinned to the mounting bracket 94 on the scraper assembly 22 and the piston 42 is retracted until the holes 85 in the horizontal extensions 80 are aligned with the pivotal attachment points 26 on the pivot brackets 27 on the hinge bar 28. Removable pins 30 are then inserted, pivotally attaching the scraper assembly 22 to the hitch 24. Further retraction of the piston 42 will rotate the scraper assembly 22 off the ground and up beneath the rear bumper 100 thus allowing the truck to be driven about without special consideration for the clearance of the rear-mounted scraper. The scraper may thus be conveniently attached and detached by the removal of the actuator 32 and the scraper assembly 22 as seasonal needs for a plow require.

The scraper 20 is advantageously mounted to the truck 62 such that the blade 81 does not protrude beyond the bumper 100. Because the scraper 20 does not interfere with the bumper 100, the protection afforded by the bumper 100 to the truck 62 is retained even while the scraper 20 is mounted. The mounting of the hydraulic actuator 32 to the blade 81 rearward of the horizontal pivot axis enables the blade to be fully deployed by an extension of the piston 42 in a compact space.

The entire assembly 20 is so compact that it may be mounted entirely beneath the vehicle. No useable space in the truck bed is consumed by the rear scraper 20, nor is the maneuverability of the truck affected by any extension of parts beyond the dimensions of the unmodified vehicle.

Furthermore, because the rear-mounted scraper 20 is fully mounted to the vehicle frame beneath the vehicle 62, the weight of the vehicle 62 contributes to the downward pressure on the blade resulting in better engagement with and removal of snow and ice.

The vehicle 62 will typically also be equipped with a conventional front-mounted plow 97, as seen in FIG. 5. When using the vehicle 62 equipped with the rear scraper 20, the vehicle 62 is simply backed up to the garage door, building or obstruction, the scraper assembly 22 is lowered to the snow-covered pavement engaging the blade 81 and the cutting bar 92 with the snow, and the vehicle 62 is driven forward pulling the snow forward over the pavement away from the obstruction or building. This maneuver of backing up to the building, lowering the scraper assembly 22 and pulling forward a distance slightly greater than the length of the truck 62, is repeated until the snow has been removed from a space around the building sufficient to allow the truck 62, with its front-mounted plow 97, to get between the building and the snow. Once this space has been cleared, the forward plow 97 may be used in the conventional manner as illustrated in FIG. 5 to complete the plowing of the driveway or the like.

The operation of the rear-mounted scraper 20 is illustrated in FIGS. 4 and 5. The vehicle 62 is backed up to close proximity with a vertical obstruction such as the wall 102. Because the mounting of the scraper 20 does not interfere with the placement or operation of the bumper 100, the bumper 100 is available to cushion slow speed impacts with the wall 102. Although severe impacts are undesireable, occasional impacts are inevitable over the course of numerous short rearward trips. Once in position, the operator in the cab 58 moves the control rod 56 which switches the double selector valve 48 so as to connect the hydraulic cylinder 32 with the pump 50 and then pushes a switch which causes the hydraulic piston 42 to extend to bring the scraper assembly 22 from its raised stowed position into a lowered, ground and snow engaging position. The linear actuator 32 may be used to apply a downward force on the snow 106 to push the blade 81 and cutting bar 92 through the snow into contact with the ground 104. The vehicle 62 then moves forward dragging the snow 106 away from the wall 102. Once a scraping operation has been completed, the actuator 32 is reversed to raise the scraper assembly 22 and return to the obstruction to remove additional snow, as shown in FIG. 5.

While the preferred hydraulic system for the scraper 20 is a hydraulic system incorporating the hydraulic system of the front snowplow, alternatively, the scraper hydraulic actuator could be operated by an independent hydraulic system.

The linear actuator has been described as a hydraulic cylinder-piston assembly but it should be understood to encompass such similar mechanisms as a rack and pinion motor-driven actuator, or the like.

Wherein the rear scraper has been described as being constructed from steel, it could effectively be constructed of any other suitable structural metal or reinforced plastic.

Additionally, wherein the rear scraper of this invention has been shown with a detachable scraper assembly, the scraper could be permanently mounted and supplied as original equipment with the truck.

The scraper of this invention requires little modification of the vehicle it is attached to. In particular, it does not require the removal of the rear bumper. Removal of the spare tire, if the vehicle to which the scraper is mounted has a spare tire mounted under the rear of the vehicle, will be required, as will rerouting of the exhaust system.

It should also be understood that although two v-shaped trusses and a single linear actuator are shown, more v-shaped trusses and linear actuators would function in the manner of this invention.

It is understood that the invention is not confined to the particular construction and arrangement of parts herein illustrated and described, but embraces such modified forms thereof as come within the scope of the following claims.

I claim:

1. A scraper for attachment to the rear of a vehicle having a rear with a rear bumper, a bottom, and a rear axle; comprising:

a) a hitch having portions attached to the bottom of the vehicle and portions defining pivotal attachment points which define a horizontal pivot axis, wherein the pivot axis of the attached hitch is spaced between the rear axle and the rear of the vehicle and is beneath the bottom of the vehicle;

b) a scraper assembly having a blade and an extension which extends forward from the blade and is pivotally mounted at the hitch pivot points to enable the scraper assembly to pivot about the horizontal pivot axis wherein the extension and the blade attached thereto are substantially overlaid by the vehicle in the raised position; and c) a linear actuator pivotally attached to the scraper assembly and to the hitch at a position near the bottom of the vehicle rear between the pivot axis and the vehicle rear axle such that operation of the linear actuator causes the scraper assembly to pivot about the pivotal attachment points on the hitch and thus move the blade from a lowered, ground-engaging, snowscraping position to a raised position beneath the vehicle and substantially forward of the rear bumper.

2. The apparatus of claim 1 wherein the vehicle has a frame at the vehicle bottom, and the hitch comprises:

a) an upper mounting bar adapted for rigid attachment to the frame beneath the vehicle at a location rearward of, above and in close proximity to the rear axle of the vehicle, wherein the linear actuator is pivotally mounted on the upper mounting bar;

b) a left and a right v-truss, wherein each v-truss has a forward bar and a rear bar, the forward bar having a first end and a second end, and the rear bar having a first end and a second end, the first end of the forward bar being adapted for rigid attachment to the frame of the truck above and to the rear of the truck axle and closely spaced from the upper mounting bar, the second end of the forward bar being attached to the second end of the rear bar forming a downward pointing "v," the second end of the rear bar being adapted for rigid attachment to the frame of the vehicle at a position spaced rearwardly from the attachment of the first member and spaced from the rear of the truck, and wherein the left v-shaped truss is spaced laterally from the right truss; and c) a hinge bar rigidly attached to the v-trusses where the forward and rear bars meet, and portions of the hinge bar define the pivot attach points defining the pivot axis.

3. The apparatus of claim 1 wherein the scraper assembly blade has a top face, a downwardly depending rear face, and two end faces joining the top and rear faces, wherein the top face has two extensions in the plane of the top face, and the extensions are spaced apart and extend forward from the blade, and each extension is pivotally mounted to a hitch pivot point, and wherein the linear actuator is pivotally mounted to a bracket mounted on the top face between the extensions and located rearward of the hitch pivot points.

4. The scraper of claim 1, the vehicle having a cab wherein the linear actuator is a double-acting hydraulic Piston cylinder assembly and further comprising a switch located in the cab for activating the hydraulic piston cylinder assembly to selectively engage the scraper with snow.

5. The scraper of claim 1 wherein the vehicle has a rear differential which is spaced from the ground and the pivotal attachment points of the hitch which define a horizontal pivotal axis are located such that the horizontal axis of the mounted scraper is spaced at least as far from the ground as the rear differential.

6. A rear-mounted scraper for attachment to a vehicle having a rear axle and a frame, comprising:

a) a hitch having a horizontal upper mounting bar rigidly attached to the frame rearward of the rear axle, a horizontal hinge bar spaced beneath and rearward of the upper mounting bar;

b) a scraper assembly having a blade for displacement of snow and an extension rigidly affixed to the blade and extending frontwardly wherein the extension is pivotally mounted to the hinge bar, and the blade is substantially overlain by the vehicle in a stowed position; and c) a horizontal actuator pivotally mounted to the upper mounting bar and to the blade at a position rearward of the extension pivotal mounting such that operation of the actuator moves the scraper assembly from a position stowed beneath the vehicle to a lowered, ground-engaging position for scraping snow.

7. The scraper of claim 6 wherein the hitch has two v-shaped trusses adapted for rigid connection to the frame of the vehicle, the trusses being rigidly connected to the hinge bar, and the trusses space the hinge bar from the upper mounting bar.

8. The scraper of claim 6 wherein the hinge bar has two horizontally spaced rearwardly extending brackets and the scraper assembly has two frontwardly extending extensions, and the extensions are pin-connected to the brackets to permit pivotal motion.

9. The scraper of claim 6 wherein the blade of the scraper assembly comprises a top face with a downwardly depending rear face and two side faces connecting the top and rear faces.

* * * * *